US005089037A

United States Patent [19]

Marsolais

[11] Patent Number: 5,089,037

[45] Date of Patent: Feb. 18, 1992

[54] INDUSTRIAL VACUUM CLEANING APPARATUS

[76] Inventor: Guy H. Marsolais, 1038, Chemin du Lac Maurice, Ste-Julienne, QC., Canada, J0K 2T0

[21] Appl. No.: 705,959

[22] Filed: May 28, 1991

[51] Int. Cl.[5] ..... B01D 29/05; B01D 29/15

[52] U.S. Cl. ..... 55/357; 55/359; 55/429; 55/471; 55/472; 55/DIG. 3

[58] Field of Search ..... 55/356, 357, 359, 428, 55/429, 432, 471, 472, DIG. 3

[56] References Cited

U.S. PATENT DOCUMENTS

| | | | |
|---|---|---|---|
| 2,535,963 | 12/1950 | Sisemore | 55/429 |
| 3,053,700 | 9/1962 | Kulp | 55/428 X |
| 3,308,609 | 3/1967 | McCulloch et al. | 55/357 X |
| 3,410,059 | 11/1968 | Garnier | 55/356 X |
| 3,706,184 | 12/1972 | Tucker | 55/356 |
| 4,061,480 | 12/1977 | Frye et al. | 55/356 |
| 4,133,658 | 1/1979 | Callewyn | 55/357 X |
| 4,695,299 | 9/1987 | Spadaro et al. | 55/429 X |
| 4,723,971 | 2/1988 | Caldas | 55/356 X |
| 4,735,639 | 4/1988 | Johnstone | 55/429 X |
| 5,037,159 | 8/1991 | Nutter et al. | 55/429 X |

*Primary Examiner*—Robert Spitzer
*Attorney, Agent, or Firm*—Roland L. Morneau

[57] ABSTRACT

A vacuum cleaner comprising a dust receiving container having an aperture for connecting a suction hose and an opening at the top for releasably supporting a motor-fan unit. A frame surrounding the container is provided with a vertically sliding structure for raising the motor-fan unit above the container at a distance sufficient to allow the container to be withdrawn sideways below the motor-fan unit. The motor-fan unit includes a dust filter, which when raised above the container, can be cleaned while allowing the dust to fall in the container.

6 Claims, 4 Drawing Sheets

INDUSTRIAL VACUUM CLEANING APPARATUS

FIELD OF THE INVENTION

The present invention relates to a vacuum cleaning apparatus and more particularly to an industrial type of vacuum cleaning apparatus having a motor fan unit removably mounted over a dust receiving container.

The motor fan unit is adapted to be raised above the dust receiving container allowing lateral retraction of the container from the apparatus.

BACKGROUND OF THE INVENTION

Industrial areas such as manufactures or warehouses have a tendency to accumulate substantial amounts of dust. Industrial types of vacuum cleaners such as the ones described in Canadian patents 664,327 and 818,763 as well as U.S. Pat. No. 4,193,161 which have large dust collecting containers are used extensively to clean such areas.

One of the major drawbacks of such industrial types of apparatus resides in the fact that the dust collecting containers are relatively heavy and cumbersome to manipulate thus creating a potential source of injury to the user.

The present invention is adapted to circumvent this disadvantage by providing an industrial vacuum cleaning apparatus having a dust collecting container which can be ergonomically retracted from the apparatus and positioned on an independent carrying cart without any lifting operation. Furthermore, the present invention also provides an industrial type of vacuum cleaning apparatus which is powered by batteries and can thus be operated for relatively long periods of time without the need to plug into electrical outlets.

DESCRIPTION OF THE DRAWINGS

Figure 1:
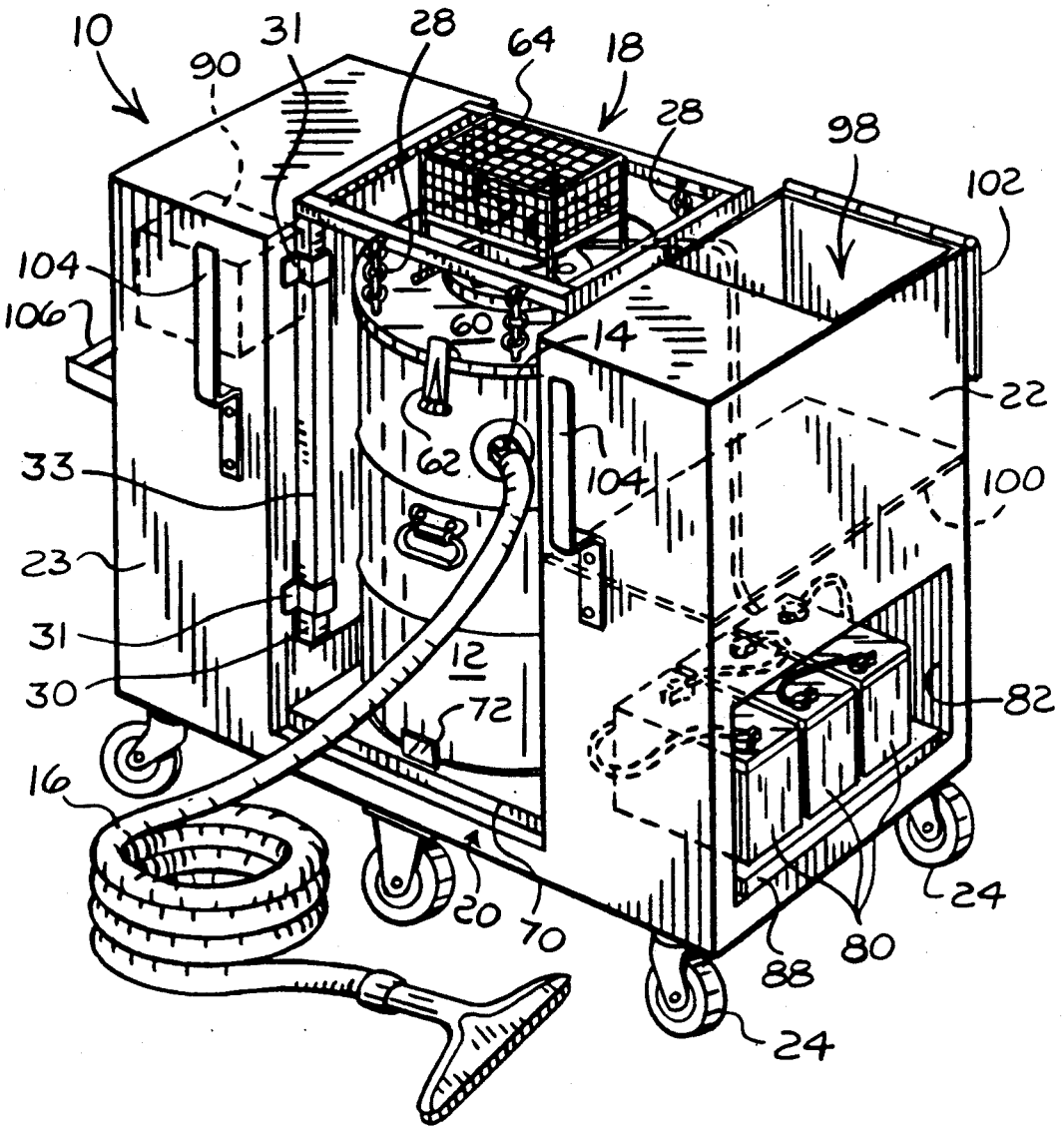
FIG. 1 is a perspective view of the cleaning apparatus according to the invention.

Referring to FIG. 1, there shown a vacuum cleaning apparatus 10 having a dust receiving container 12. The container 12 is provided with an aperture 14 for connecting a vacuum cleaning hose 16. A motor fan unit 18, adapted to create a vacuum inside the container 12, is removably fixed over the upper end of the container 12.

The container 12 is mounted on a cart 20 having upwardly extending lateral compartments 22 and 23. A set of wheels 24 are fixed to the bottom of the cart 20.

Figure 4:
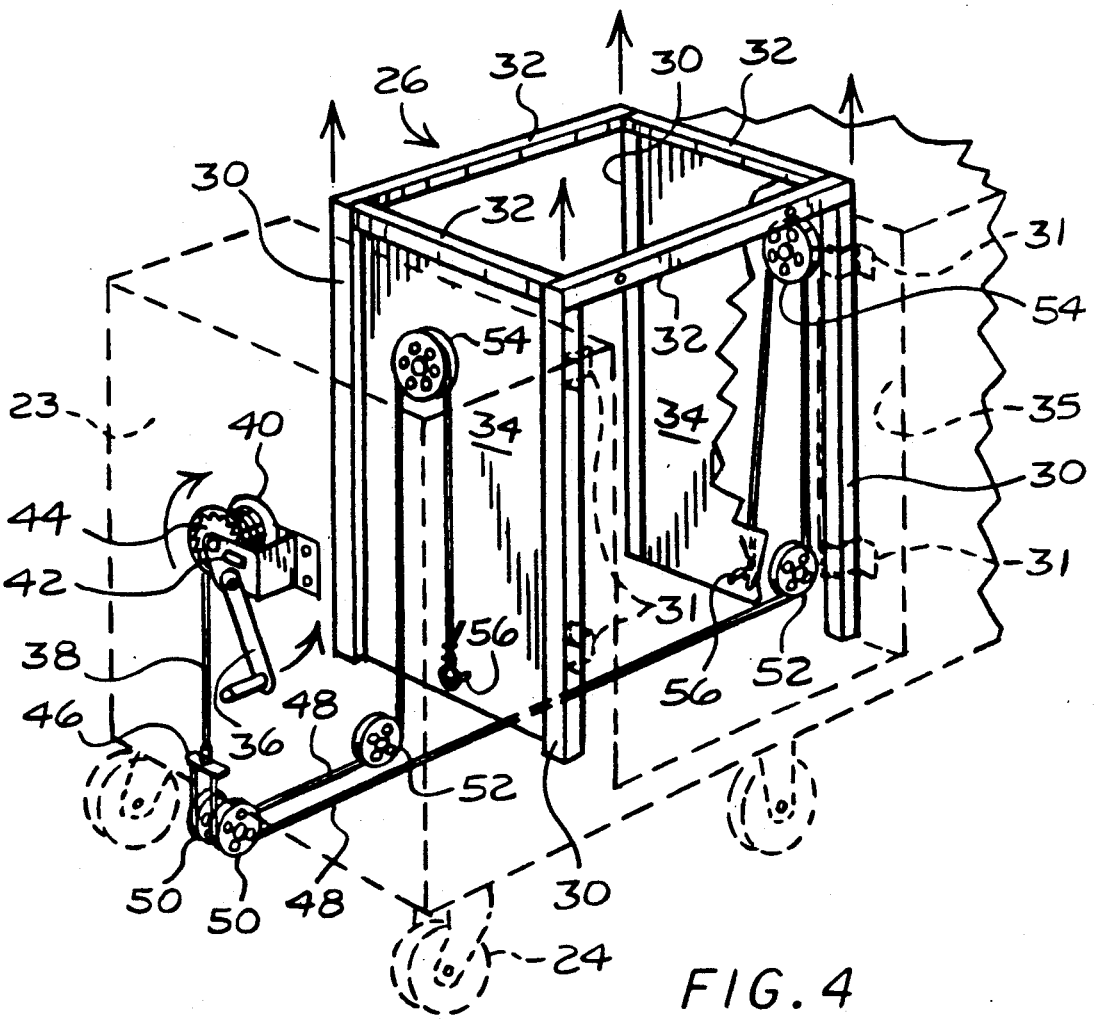
FIG. 4 is a perspective view illustrating the structure for raising the motor fan unit.
Figure 5:
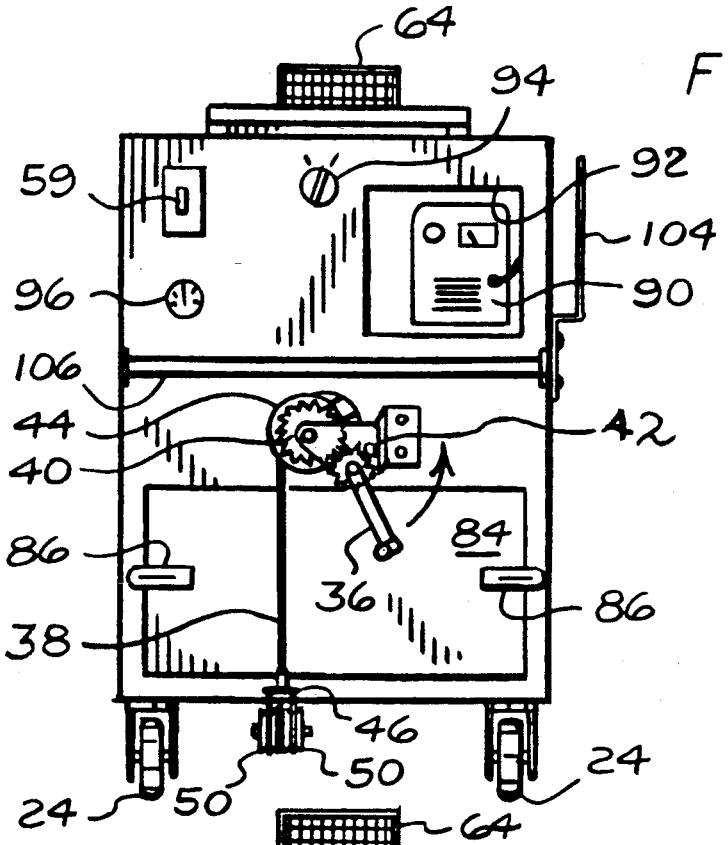
FIG. 5 is a side view of the apparatus with the structure supporting the motor fan unit in its lowermost position.

A raising structure 26 is slidingly mounted between the compartments 22 and 23. Referring more specifically to FIG. 4, the raising structure 26 comprises four vertical structural members 30 kept in horizontally spaced relationship by four horizontal structural members 32. A pair of structural plates 34 are rigidly fixed to the vertical structural members 30 thus defining side walls for the raising structure 26. A set of guiding sleeves 33 are rigidly fixed to the inner surface 35 of the compartments 22 and 23 by a set of brackets 31. The sleeves 33 are adapted to guide the vertical members 30 and prevent tilting of the raising structure 26.

Figure 3:
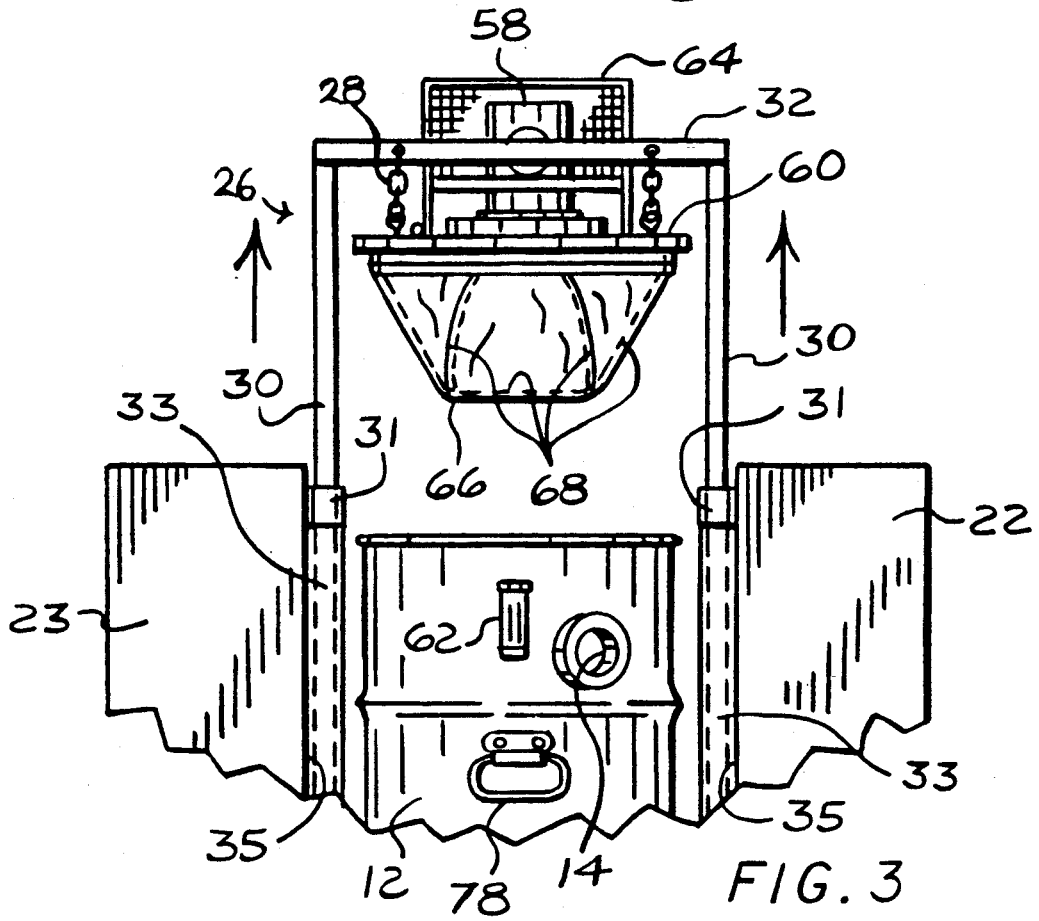
FIG. 3 is a partial view of the top portion of the apparatus, as shown in FIG. 2, with the motor fan unit raised over the dust receiving container.
Figure 6:
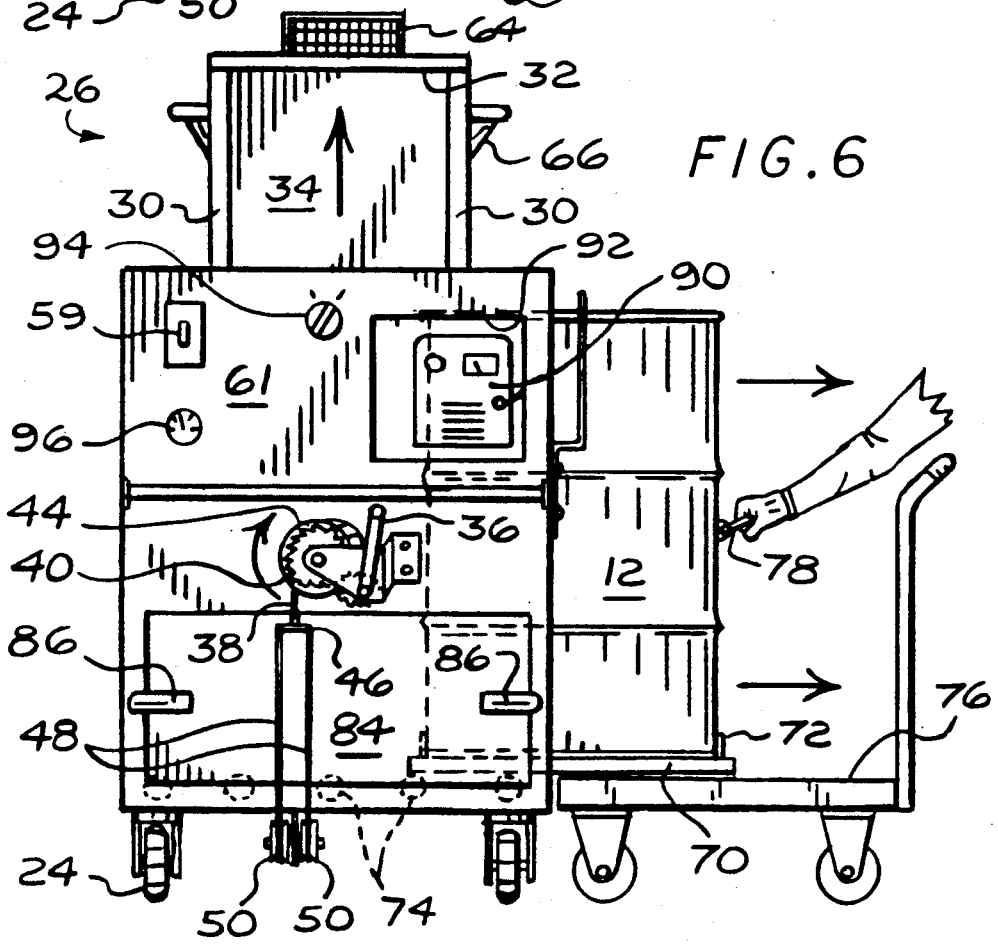
FIG. 6 is a side view of the apparatus with the structure supporting the motor fan unit being raised and the dust receiving container being transferred to a small independent carriage.

The motor fan unit 18 is linked to the raising structure 26 by a set of chains or snap fasteners 28. The raising structure 26 is thus adapted to raise the motor fan unit 18 as illustrated in FIGS. 3 and 6. The raising structure 26 is mechanically lifted by the user upon rotation of a crank 36 linked to a cable and pulley system illustrated more specifically in FIG. 4. Rotation of the crank 36 allows winding or unwinding of a winding cable 38 around a reel 40. The reel 40 is adapted to be rotatably locked by a locking mechanism using a tiltable locking arm 42 and a toothed wheel 44.

Figure 2:
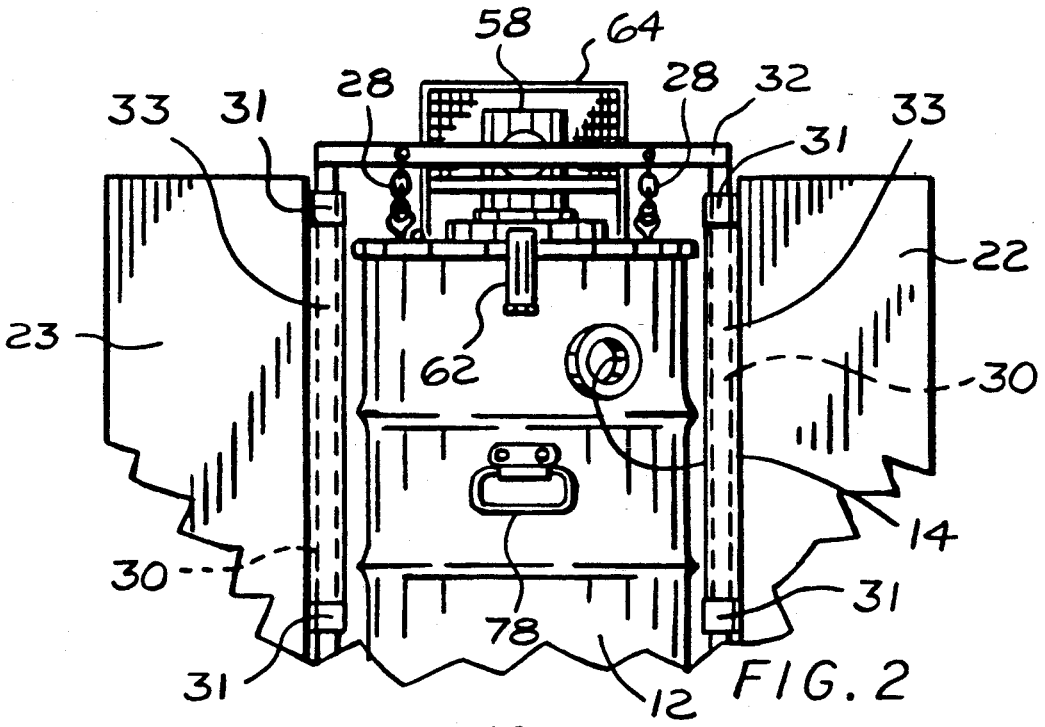
FIG. 2 is a partial front view of a top portion of the apparatus with the motor fan unit resting on top of the dust receiving container.

The winding cable 38 is attached to the top portion of a splitting element 46. A pair of redirecting cables 48 are attached to the bottom portion of the splitting element 46. A pair of external bottom pulleys 50 rotatably attached to the bottom portion of the back compartment 23 are used to redirect the cables 48 from a vertical path along the side of the back compartment 23 to a horizontal path under the cart 20. The pair of internal bottom pulleys 52 rotatably attached to the bottom of the cart 20 adjacent the walls 35 redirect the cables 48 towards a pair of internal upper pulleys 54 which vertically invert the path of the cable 48. Each one of the cables 48 is attached to a corresponding hooking handle 56 fixed to the bottom of the structural plates 34. The upper pulleys 54 are rotatably mounted on the cart with their axis of rotation perpendicular to the plates 34 thus optimizing a limited space between the plates 34 and the internal walls 35 of the compartments 22 and 23. The motor fan unit 18 comprises a motor fan blower 58 mounted on a cover 60. The motor 58 is typically a 36 volts DC 3 phase 1.25 horsepower type of motor using 26 amps. This type of motor is sold by Ametek Company, Lamp Electric Division, in Kent, Ohio. The motor is turned on or off through a switch 59 located on a front panel 61 of the compartment 23. A set of clips 62 (FIG. 2) pivotally mounted on the dust receiving container are used to grip the rim portion of the cover 60 and sealingly lock the cover 60 on the container 12. A protective cage 64 is positioned over the motor fan unit 18 and fixed to the cover 60. A filtering cloth 66 adapted to filter the foul air before it escapes through the motor 58, is sealingly suspended under the cover 60. The cloth 66 is preferably made out of 100% cotton weaved tightly in a crossed pattern. The filtering cloth 66 can be purchased at Texlina Inc. in Ste-Julie, Qué bec, Canada. A set of reinforcing ribs 68 prevent the cloth 66 from upwardly collapsing when the air is pulled upwardly by the motor 58.

Another main advantage of the present invention resides in the fact that since the cover 60 is lifted in a straight vertical motion, the filtering cloth 66 remains directly over the dust receiving container 12 and can thus be cleaned with a minimal risk of dust particles falling around the container 12. In use, the lifting mechanism is raised and a conventional portable hand vacuum cleaner, such as a 12 volt car vacuum cleaner, is used to remove the dust particles remaining on the outer surface of the filtering cloth 66. A 12-volt outlet (not shown) is provided, for that purpose, on the cart. The particles which fall from the filtering cloth 66 are caught by the dust receiving container 12 located directly underneath it. The dust receiving container 12 rests on a sliding support plate 70. The container 12 is prevented from sliding off the plate 70 by a pair of abutting stoppers 72. The sliding plate 70 is slidingly mounted on a set of transfer bearing 74 rotatably fixed to the cart 20.

As illustrated in FIG. 6, the dust receiving container 12 can easily be transferred to a small independent carriage 76, without any lifting operation, by a simple pulling action on a handle 78 provided on the container 12. The carriage 76 can be used to roll the container 12 over to a proper processing site.

Another feature of the present invention resides in its capacity to operate for a relatively long period of time without the neccesity to plug it into an electrical supply outlet. Power is supplied to the motor fan unit 18 by a set of six, 6 volt batteries 80 serially linked. The batteries 80 are grouped in sets of three and each set is located in a recess 82 provided at the bottom of a respective compartment 22 or 23. The recess 82 are closed off by doors 84. The doors 84 are locked by locking clips 86. Each set of three batteries 80 are positioned on a small sliding plate 88 which allows them to be easily pulled out for maintenance. The batteries 80 can be electrically linked either to the motor 58 or to a charger 90 located in a recess 92 provided in the back compartment 23. Linkage of the batteries 80 to either the motor 58 or the charger 90 can be selected through the use of a selector 94 positioned on the front panel 61 of the back compartment 23. The charger 90 is adapted to be plugged into a conventional 110 volt electrical outlet. A charger which balances the charges in each cell at the end of the charging cycle such as the "varta basic desing 80, 18 cells 36 volts" charger is suitable.

The charge level of the batteries 80 can be acknowledged through a reading of a battery charge indicating dial 96 also located on the panel 61 of the back compartment 23.

As illustrated in FIG. 1, a storage compartment 98 having a bottom panel 100 is provided above the batteries in the front compartment 22. A top cover 102 pivotally mounted on the compartment 22 closes off the storage compartment 98. A pair of supporting arms 104 adapted to support the hose 16 when the vacuum cleaner is not in use, are fixed to the side of the cart 20. A main handle 106 used to pull or push the cart 20 is fixed to the back compartment 23.

I claim:

1. A vacuum cleaning device comprising, a wheeled cart having a platform, a dust receiving container opened at its upper end and provided with an aperture for connecting a suction hose, said container being freely mounted on said platform, a motor-fan unit mounted over said upper end of said container and removably fixed thereon, said unit adapted to create a suction in said container, said unit comprising a dust filtering cover adapted to retain the dust entering from said suction hose, an upstanding frame fixed to said platform and laterally disposed relative to said container, said frame comprising four upstanding guiding sleeve members peripherally disposed around said container and fixed to said platform, a structure fixed to said frame for supporting said motor-fan unit, said structure having a set of four vertical beams slidingly mounted relative to said guiding sleeve members, and a set of horizontal beams connecting said vertical beams for supporting said motor-fan unit at a level suitable for sealingly lock said cover on said container, and means slidingly mounted on said structure for raising said motor-fan unit above said upper end of said container at a distance sufficient to clear the container, said container being adapted to slide on said platform adjacent said frame.

2. A vacuum cleaning device as recited in claim 1, wherein said means for raising said motor-fan unit comprises a set of cable and pulleys for upwardly pulling said vertical beams in said guiding sleeve members and a winding reel connected to said cables for vertically moving said structure and said motor-fan unit vertically above said container.

3. A vacuum cleaning device as recited in claim 2, wherein said pulleys includes a first pair of pulleys laterally mounted on said frame and a second pair of pulleys mounted on said platform, said cables including a pair of cables, each cable being hooked at one end to said structure and extending through one pulley of each pair of pulleys, whereby the actuation of said reel vertically displaces said cover over said container for clearing said unit above container.

4. A vacuum cleaning device as recited in claim 2, wherein said dust cover comprises a piece of cloth filteringly sealing the lower part of the motor-fan unit for preventing the dust particles from moving from said container outwardly through said unit.

5. A vacuum cleaning device as recited in claim 3, wherein two of said vertical beams are spaced from each other to allow retraction of said container from said platform when said unit is raised above the container to clean the latter.

6. A vacuum cleaning device as recited in claim 4, wherein said unit is D.C. actuatable with batteries mounted on said platform for actuating said unit.

* * * * *